US008721211B2

(12) United States Patent
deVirag et al.

(10) Patent No.: US 8,721,211 B2
(45) Date of Patent: May 13, 2014

(54) SPREADABLE FOOD DISPENSER SYSTEM

(75) Inventors: Francis Kiss deVirag, Kirtland Hills, OH (US); Alexander Sterling Wise, Mentor, OH (US); Ileen Rosner, Novelty, OH (US); Jonathan Rosner, Novelty, OH (US)

(73) Assignee: Innovative Consumer Solutions, LLC, Novelty, OH (US)

( * ) Notice: Subject to any disclaimer, the term of this patent is extended or adjusted under 35 U.S.C. 154(b) by 1281 days.

(21) Appl. No.: 11/847,249

(22) Filed: Aug. 29, 2007

(65) Prior Publication Data

US 2009/0202289 A1 Aug. 13, 2009

Related U.S. Application Data

(60) Provisional application No. 60/823,864, filed on Aug. 29, 2006.

(51) Int. Cl.

| | |
|---|---|
| ***B43K 5/06*** | (2006.01) |
| ***B05C 17/005*** | (2006.01) |
| ***B05C 11/00*** | (2006.01) |
| ***B65D 83/64*** | (2006.01) |

(52) U.S. Cl.

CPC ..... *B05C 17/00516* (2013.01); *B05C 17/005* (2013.01); *B05C 11/00* (2013.01); *B65D 83/64* (2013.01)

USPC ..... 401/175; 401/174; 401/263; 401/265; 401/266

(58) Field of Classification Search

CPC ..... B05C 17/005; B05C 17/00503; B05C 17/00516; B05C 17/00589; B05C 11/00; B65D 5/746; B65D 47/42; B65D 83/64

USPC ..... 401/172, 174, 175, 265, 266, 171; 222/63, 326, 333, 390

See application file for complete search history.

(56) References Cited

U.S. PATENT DOCUMENTS

| | | | | |
|---|---|---|---|---|
| 5,797,692 | A * | 8/1998 | Poole et al. | 401/266 |
| 5,890,630 | A * | 4/1999 | Lobdell | 401/266 |
| 6,688,793 | B2 * | 2/2004 | Goyet | 401/175 |
| 6,957,925 | B1 * | 10/2005 | Jacobs et al. | 401/175 |

* cited by examiner

*Primary Examiner* — Tuan N Nguyen

(74) *Attorney, Agent, or Firm* — Amin, Turocy & Watson, LLP

(57) ABSTRACT

A dispenser for spreadable foodstuffs and other spreadable non-food substances allowing for spreading without the need for additional utensils not a part of the packaging is disclosed. The dispenser may rapidly switch between different disposable cartridges and is designed for an extended useful lifetime.

13 Claims, 2 Drawing Sheets

SPREADABLE FOOD DISPENSER SYSTEM

TECHNICAL FIELD

The subject invention generally relates to a device for dispensing spreadable food products or other spreadable non-food substances. In particular, the subject invention relates to dispensing spreadable products evenly from a container without the use of a knife or other utensils not part of the food packaging.

BACKGROUND

The vast majority of packaging of spreadable foodstuffs lack any functionality to allow contents to be used directly from the packaging. The packaging for spreadable foodstuffs such as ketchup, mustard, cream cheese, peanut putter, jelly, etc. typically require a knife or other utensil not part of the food packaging to remove the foodstuff from a container and/or achieve spreading the foodstuff as desired. Even containers that allow for squeezing the foodstuff contained therein directly out of the packaging often still require a utensil not part of the food packaging to evenly spread the foodstuff. Such containers also often do not dispense foodstuffs easily as the void space of the container increases as foodstuff is consumed. Often the contents may splatter or take a significant amount of time to flow due to a large volume of air in the container. Air being introduced to the container during the products use also negatively affects product freshness.

Traditional food containers are also typically challenging for children, elderly, disabled, or physically challenged individuals to use. Such containers also require utensils to be washed after every minor use of the product, which is a particular inconvenience during such activities as traveling, picnics, or other occasions where typical kitchen home amenities are not present in addition to individuals who do not own a dishwasher.

The invention is also designed for use with a variety of non-food semi-solid or gelatinous substances. These substances include but are not limited to toothpaste, shoe polish, paints, cosmetics, thick oils, topical medications, and emollients. The typical containers for these substances are often the same and have the same limitations as those used for foodstuffs. These main limitations being the need for additional utensils to remove and use the substance from the container, air being introduced to the containers over time as the substance is used, and difficulty of use for children or individuals with physical limitations.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention provides for spreadable foodstuffs and non-food substances to be packaged in a container that has a means for spreading the contained foodstuff or substance in a knife-like manner without the use of any additional utensils not part of the packaging as well as providing for a packaging of adjustable volume such that product is kept away from air during use.

One aspect of the invention relates to providing a convenient means of use of spreadable foodstuffs or substances in residences without the need for utensils not part of the food packaging. An additional aspect of the invention relates to providing a convenient and easy to use means for spreading spreadable foodstuffs or substances for elderly, disabled, children, and physically challenged persons. Another aspect of the invention relates to providing a convenient means of use of spreadable foodstuffs or substances for those traveling, picnics or other outdoor activities, or other times when traditional amenities are not available.

Yet another aspect of the invention relates to providing a means for restaurants and caterers to dispense and use spreadable foodstuffs or substances with greater speed. Still yet another aspect of the invention relates to providing a packaging for spreadable foodstuffs that keeps contents fresher once seal on package has been broken.

Another aspect of the invention relates to minimizing waste of the spreadable foodstuff or substance compared to traditional packaging.

An additional aspect of the invention is to provide a packaging that is less disposable than traditional packaging and therefore suitable for targeted and affinity marketing in a more affective manner. Still yet another aspect of the invention is to provide for an automated means of dispensing spreadable foodstuffs and substances that may easily and rapidly switch between dispensing different foodstuffs. An additional aspect of the invention is to provide an automated means of dispensing spreadable foodstuffs and substances that is ergonomical.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

The packaging is comprised of a substantially cylindrically shaped dispenser which is ergonomically designed to fit comfortably in the human hand. The substantially cylindrically shaped dispenser may or may not have varying widths. The dispenser has an extended useful lifetime and can be used to dispense several different kinds of foodstuffs. The foodstuff or other spreadable substance is supplied as a replacement cartridge product (RCP). The RCP is a cylindrical tube composed of rigid or semi-rigid food-grade or chemical resistance plastic as the application dictates. One end of the RCP has a coupling mechanism allowing the RCP to reversibly attach to the dispenser. The other end of the RCP has an applicator portion that has a knife-like shape and is permanently molded to the rest of the RCP. The knife-like applicator has a triangular shape. One edge of the applicator has a series of holes or openings through which foodstuffs or other spreadable substances pass upon dispensing. In this manner, the contained product may be dispensed directly to the location of desired use and immediately spread without the use of any other utensils besides the dispenser and the RCP, which form one complete unit during use.

The mechanical operation of the dispensing system is as follows. The RCP contains a screw-spindle running along the longitudinal axis of the RCP. The end of the RCP that attaches to the dispenser is formed of a plunger member that is attached to said screw spindle. The plunger member forms a tight seal with the body of the RCP but still capable of sliding along the body of the RCP. When the RCP is attached to the dispenser, the screw spindle fits into a receptacle on the coupling end of the dispenser. A mechanism inside the dispenser turns the screw-spindle which in turn moves the plunger member along the body of the RCP. Movement of the plunger member expels spreadable foodstuffs or substances through the opening on the applicator. The mechanism inside the dispenser may either be powered manually by the user or by an electric motor. The RCP is designed to be disposable upon use of most or all the product contained inside.

Figure 1:
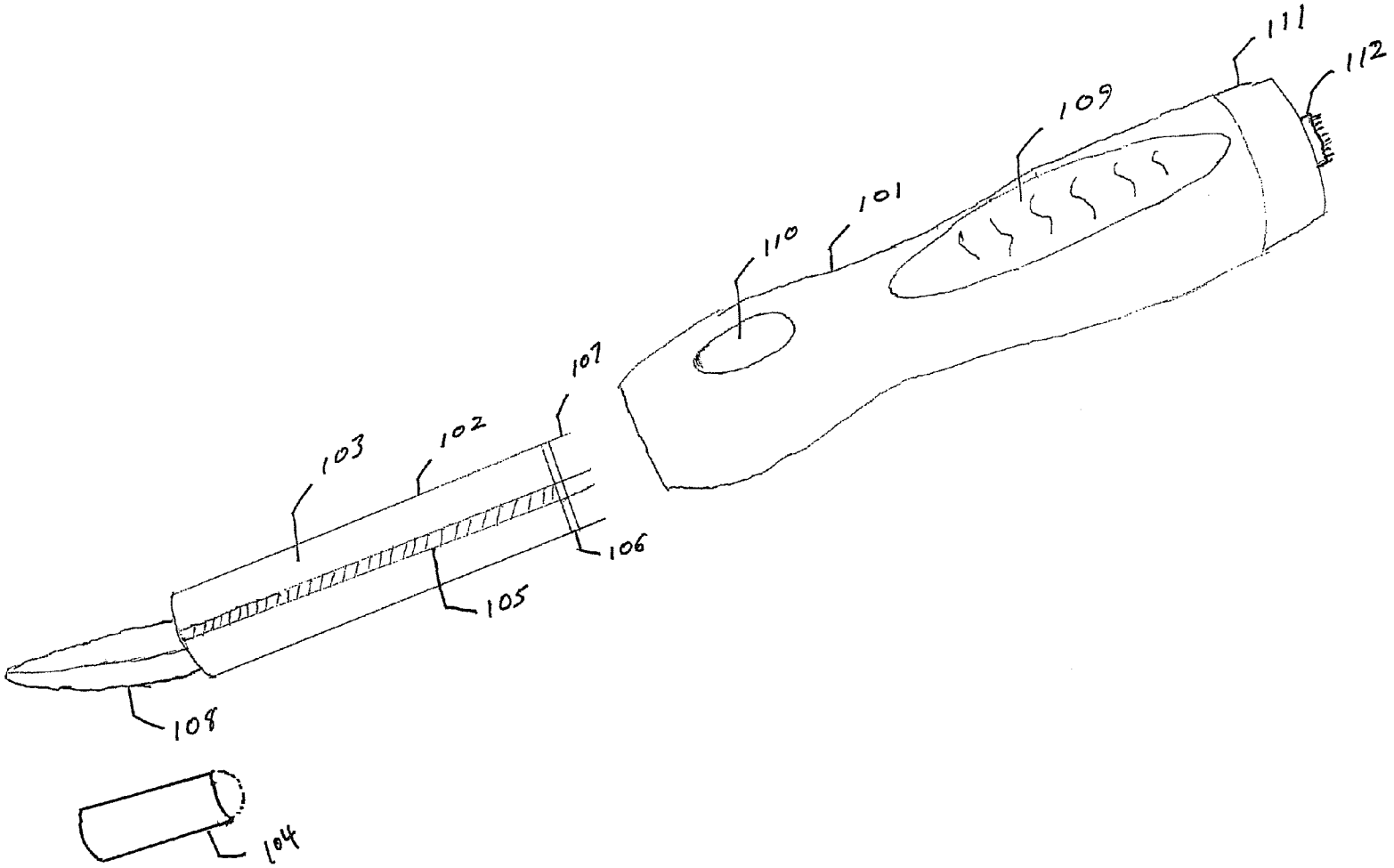
FIG. 1 is a view of the first embodiment of the invention comprising a disposable cartridge and dispensing handle drawn detached from each other.

One embodiment of the dispenser is depicted in FIG. 1. The body of the dispenser 101 is composed of rigid food grade or chemical resistant material depending on application. Similarly, the body of the RCP 102 is composed of rigid or semi-rigid food grade or chemical resistant material. The RCP comprises mostly a hollow space 103, which contains the spreadable foodstuffs or substances. The spreadable foodstuff is kept fresh by a lid 104 before the RCP is placed in use. The lid 103 can be replaced such that the RCP can be detached from the dispenser before the contents are completely consumed. There is a screw-spindle 105 running along the longitudinal axis of the RCP. There is a plunger member 106 located at one end of the RCP and a lip 107 surrounding that end of the RCP. The plunger member 106 and lip 107 are designed in such that a part of the dispenser may extent past the lip and engage the screw-spindle 105. A tube may optionally be placed along the longitudinal axis of the RCP such that the screw-spindle 105 is kept out of contact with the product contained in the hollow space 103. If need be, the product can be manually squeezed out of the RCP when the RCP is constructed out of semi-rigid material. The RCP can be designed to attach to the dispenser through a latch and spring mechanism or a twist and lock mechanism, which are both extremely common in the art.

Figure 2:
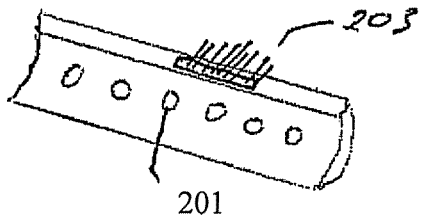
FIG. 2 is a view of the knife-like applicator with a modification of smaller openings for less viscose products.
Figure 3:
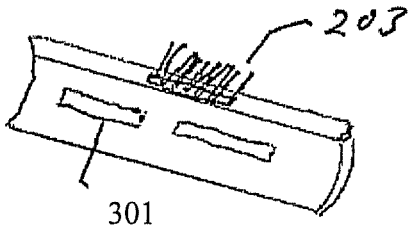
FIG. 3 is a view of the knife-like applicator with a modification of larger openings for more viscose products.

The dispensing end of the RCP 108 is in one piece with the RCP 102 and is shaped in a triangular knife-like shape. Several variations of the applicator region are shown in FIG. 2 and FIG. 3. The number and diameter of the openings is selected based on the consistency or viscosity of the product. For example, dispensing end 203, as shown in FIG. 2 can have a large number of smaller holes 201 for less viscose products such as jelly, ketchup, or emollients. One or two large holes 301, as depicted in dispensing end 203 in FIG. 3, are appropriate for very viscose products such as peanut butter, cream cheese, or toothpaste. The flat surface of the applicator is used in a knife-like fashion to spread the foodstuffs or other spreadable substances as desired. Also, depending of the viscosity of the products, the products may be dispensed completely onto a surface and then spread. For some high viscosity products, dispensing of such products may preload the head with product that may then be spread onto a desired location.

The dispenser may optionally have one or more rubber grips 109 on the body of the dispenser 101. In a second embodiment of the dispenser of the invention, the screw-spindle 105 is rotated manually upon depressing a button 110 located on the surface of the RCP. Methods for coupling the mechanical depression of a button to rotation of a gear and/or screw spindle are well known in the art. In a third embodiment of the dispenser of the invention, the screw-spindle 105 is rotated via an electric motor and battery located within the dispenser. The motor is activated upon depression of button 110. The battery may be rechargeable from a DC power source for high use applications such as restaurants. In either embodiment, the dispenser has a manual override consisting of a rotating wheel 111 located on the end of the dispenser. Additionally, certain applications, such as shoe polish or paints, may benefit from built-in bristles or brush on the container. Such bristles or brushes may be built into the dispensing unit 112, the knife-like applicator or the RCP 102, or any other convenient location on the packaging.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispensing system comprising:

a replaceable cartridge combining an applicator and a container, the applicator being knife-like and having at least one opening, wherein the replaceable cartridge contains a foodstuff or a non-food substance and the applicator receives the foodstuff or the non-food substance through the at least one opening;

wherein the replaceable cartridge is disposable upon use of all or most of the foodstuff or the non-food stuff substance inside;

a tube located in the replaceable cartridge along the longitudinal axis of the replaceable cartridge, a screw-spindle located within the tube, the screw-spindle arranged along the longitudinal axis, the screw-spindle attached to a plunger member located within the replaceable cartridge, wherein rotation of the screw-spindle results in movement of the plunger member along the longitudinal axis of the replaceable cartridge;

wherein the replaceable cartridge is removably attached to a dispenser, the dispenser comprising an electric motor capable of engaging the screw-spindle;

wherein movement of the plunger member along the longitudinal axis dispenses the foodstuff or the non-food substance from the container through the at least one opening of the applicator;

a rechargeable battery connected to the electric motor; and a wheel located at one end of the dispenser such that it is accessible to a user.

2. The dispensing system of claim 1, wherein the applicator comprises built-in bristles or a brush.

3. The system of claim 1, further comprising a button located on the replaceable cartridge and connected to the screw-spindle.

4. The system of claim 1, wherein the replaceable cartridge is removably attached to the dispenser by a latch and spring or twist and lock mechanism.

5. The system of claim 1, wherein the number of openings of the applicator is based on at least one characteristic of the foodstuff or non-food substance.

6. The system of claim 1, wherein the applicator is directly attached to the replaceable cartridge.

7. A method of dispensing foodstuffs and non-food substances from a dispenser, comprising:

attaching a replaceable cartridge to a dispenser, the replaceable cartridge containing a foodstuff or non-food substance;

rotating a screw-spindle located within a tube located within the replaceable cartridge and arranged along the longitudinal axis of the replaceable cartridge using an electric motor located within the dispenser and connected to a rechargeable battery, wherein rotating the screw-spindle moves a plunger member located within the replaceable cartridge;

depositing the foodstuff or non-food substance onto an applicator permanently attached to the replaceable cartridge, wherein the applicator is knife-like and has at least opening for passing the foodstuff or non-food substance from the replaceable cartridge and onto the applicator;

spreading the foodstuff or non-food substance on a surface; and disposing of the replaceable cartridge upon use of all or most of the foodstuff or the non-food stuff substance inside.

8. The method of claim 7, further comprising selecting the size of the at least one opening to accommodate the viscosity of the foodstuff or non-food substance.

9. The method of claim 8, further comprising activating a button to activate the electric motor.

10. The method of claim 7, further comprising preloading the applicator with the foodstuff prior to spreading the foodstuff or non-food substance on a surface.

11. The method of claim 7, further comprising selecting the quantity of the at least one opening to accommodate the viscosity of the foodstuff or non-food substance.

12. The method of claim 7, with the proviso that the method does not comprise spreading the foodstuffs or non-food substance with utensils that are not attached to the replaceable cartridge.

13. The method of claim 7, further comprising attaching the replaceable cartridge to the dispenser by a latch and spring or twist and lock mechanism.

* * * * *